US011290793B2

(12) United States Patent
Huang et al.

(10) Patent No.: US 11,290,793 B2
(45) Date of Patent: Mar. 29, 2022

(54) SOUNDING DEVICE AND MOBILE TERMINAL

(71) Applicant: AAC Technologies Pte. Ltd., Singapore (SG)

(72) Inventors: Xingzhi Huang, Shenzhen (CN); Lin Liu, Shenzhen (CN); Dijiang Tong, Shenzhen (CN); Zhe Zhang, Shenzhen (CN); Jun Wu, Shenzhen (CN); Zhichen Chen, Shenzhen (CN); Zhaoyu Yin, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 47 days.

(21) Appl. No.: 16/992,144

(22) Filed: Aug. 13, 2020

(65) Prior Publication Data

US 2021/0029425 A1 Jan. 28, 2021

Related U.S. Application Data

(63) Continuation of application No. PCT/CN2019/098143, filed on Jul. 29, 2019.

(30) Foreign Application Priority Data

Jul. 23, 2019 (CN) ..... 201910668222.3

(51) Int. Cl.
*H04R 1/02* (2006.01)
*H04R 1/32* (2006.01)

(52) U.S. Cl.
CPC ..... *H04R 1/02* (2013.01); *H04R 1/32* (2013.01)

(58) Field of Classification Search
CPC .... H04R 2499/11; H04R 1/02; H04R 1/2811; H04R 1/28; H04R 2400/11; H04R 1/026; H04R 1/2807; H04R 31/006; H04R 9/02; H04R 9/022; H04R 1/2823; H04R 1/00; H04R 1/2884; H04R 1/32; G10K 9/22
USPC ..... 381/337, 338, 339, 345, 347–352, 387, 381/163, 357
See application file for complete search history.

(56) References Cited

U.S. PATENT DOCUMENTS

2014/0065937 A1* 3/2014 Schneider ..... B64D 13/00 454/73
2014/0126761 A1* 5/2014 Pham ..... H04R 1/2811 381/353

FOREIGN PATENT DOCUMENTS

EP 1696696 * 8/2006

* cited by examiner

*Primary Examiner* — Norman Yu
(74) *Attorney, Agent, or Firm* — W&G Law Group

(57) ABSTRACT

The invention provides a sounding device having a housing body with a containment space, a sound outlet formed in the housing body, a speaker unit fitted in the housing body, an intake valve that communicates the outside with the front cavity and that is used for introducing air into the front cavity, and an unidirectional outlet valve that communicates the front cavity with the outside and discharges air in the front cavity to the outside through the sound outlet. The speaker unit separates the containment space into a front acoustic cavity and a back cavity, the sound outlet is communicated with the front acoustic cavity and forms a front cavity together. The invention also provides a mobile terminal. Compared with the related art, the sounding device and the mobile terminal of the invention have better reliability and better performance.

2 Claims, 3 Drawing Sheets

SOUNDING DEVICE AND MOBILE TERMINAL

FIELD OF THE PRESENT DISCLOSURE

The invention relates to the electroacoustic conversion field, in particular to a portable sounding device and a mobile terminal.

DESCRIPTION OF RELATED ART

With the advent of the mobile Internet era, the number of smart mobile terminals is increasing continuously. Among many mobile devices, mobile phone is undoubtedly the most common and portable mobile terminal. At present, the functions of mobile phones are extremely diverse, and with the higher requirements of mobile phone performance, the internal components of mobile phones are increasing.

However, in the mobile terminal of related art, the increase of internal components leads to the increase of internal heat generation, and the single function of each component, such as sounding device, is only used for sounding, which causes the temperature of the mobile phone to be too high and affects its functionality and stability.

Therefore, it is necessary to provide a new sounding device and mobile terminal to solve the above technical problems.

SUMMARY OF THE INVENTION

One of the main objects of the present invention is to provide a sounding device and a mobile terminal with heat dissipation function.

Accordingly, the present invention provides a sounding device comprising: a housing body having a containment space; a sound outlet formed in the housing body; and a speaker unit fitted in the housing body. The speaker unit separates the containment space into a front acoustic cavity and a back cavity. The sound outlet is communicated with the front acoustic cavity and forms a front cavity together. The sounding device further includes an unidirectional intake valve communicating the outside with the front cavity and for introducing air into the front cavity, and an unidirectional outlet valve communicating the front cavity with the outside and for discharging air in the front space through the sound outlet to the outside world.

Further, the unidirectional intake valve extends through the housing body and communicates the outside with the front acoustic cavity, the unidirectional outlet valve is arranged in the sound outlet and connects the sound outlet with the outside.

The present invention further provides a mobile terminal, comprising: a housing having an accommodation space and a sounding device as described above fitted in the housing; wherein the housing includes an air inlet and an air outlet respectively communicating the accommodation space with the outside; the accommodation space is communicated with the front cavity through the unidirectional intake valve, the unidirectional outlet valve communicates the front cavity with the air outlet.

Further, the housing comprises a hollow annular frame and an upper cover and a lower cover which are respectively arranged on two sides of the frame as a cover and enclose the accommodation space together with the frame; the air outlet is arranged at the frame, and the air inlet is arranged at one end of the upper cover far away from the air outlet; the front acoustic cavity is arranged close to the lower cover, the back cavity is arranged close to the upper cover; the unidirectional intake valve passes through the housing body and communicates the accommodation space with the front acoustic cavity; the unidirectional outlet valve is arranged in the sound outlet and connects the sound outlet with the air outlet.

Further, the housing further comprises an air outlet pipe extending from the frame into the accommodation space, the air outlet pipe has one end abutting against the sound outlet and communicated with each other, and another end abutting against the air outlet and communicated with each other.

Further, the surface on which the air outlet pipe and the sound outlet abut on each other is an inclined surface.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
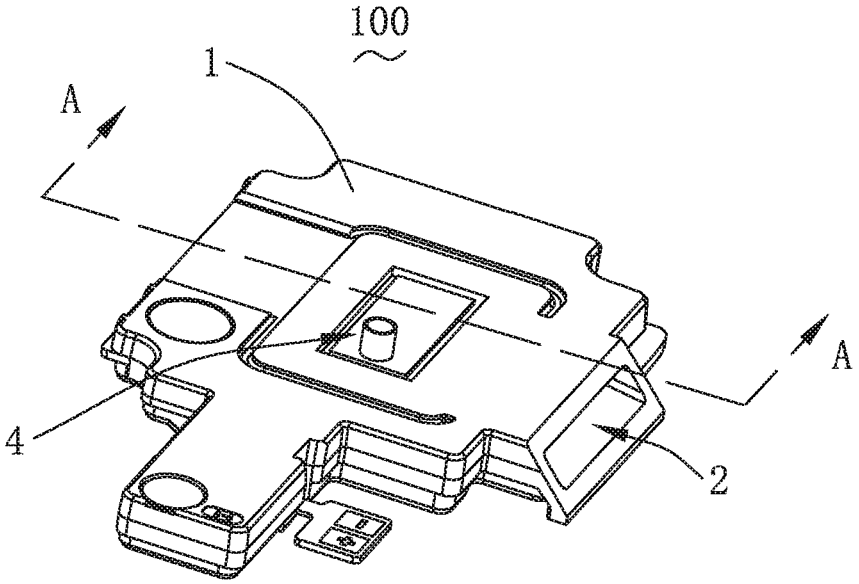
FIG. 1 is an isometric view of a sounding device in accordance with an exemplary embodiment of the present invention.
Figure 2:
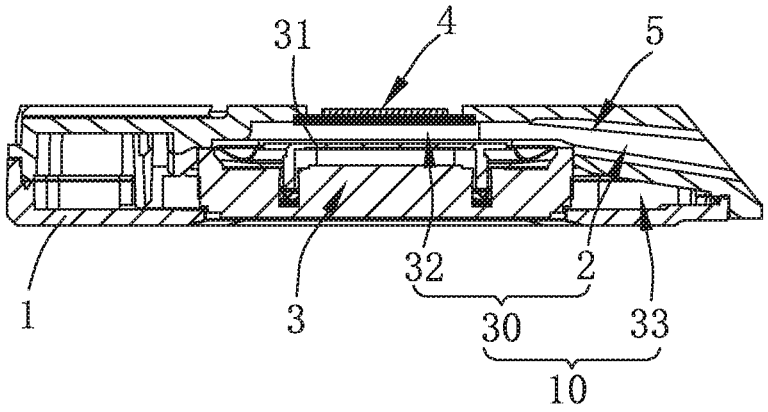
FIG. 2 is a cross-sectional view of the sounding device taken along line A-A in FIG. 1.
Figure 3:
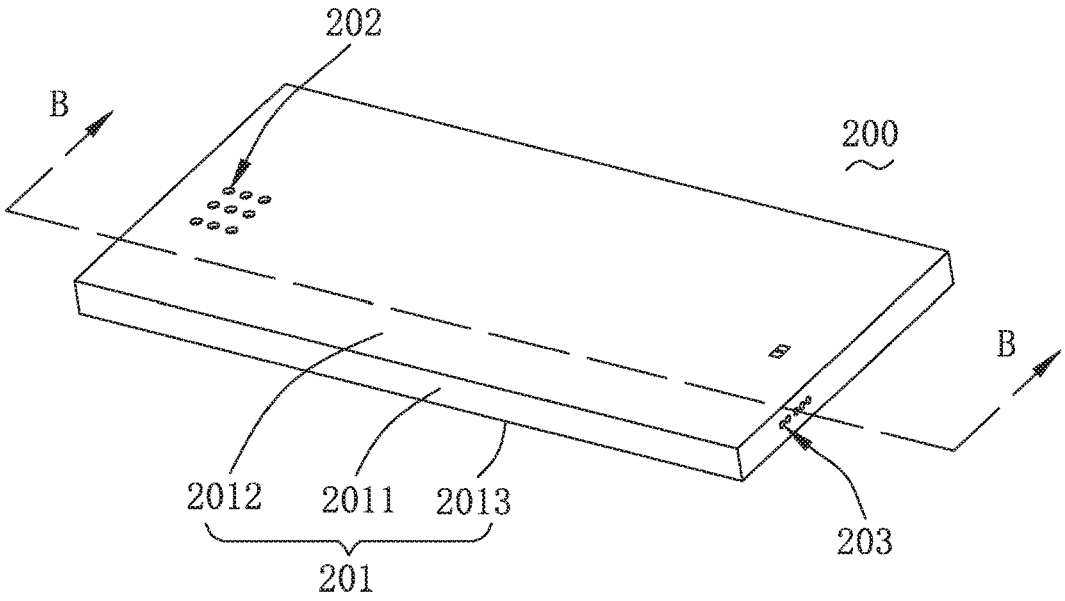
FIG. 3 is an isometric view of a mobile terminal of the present invention.
Figure 4:
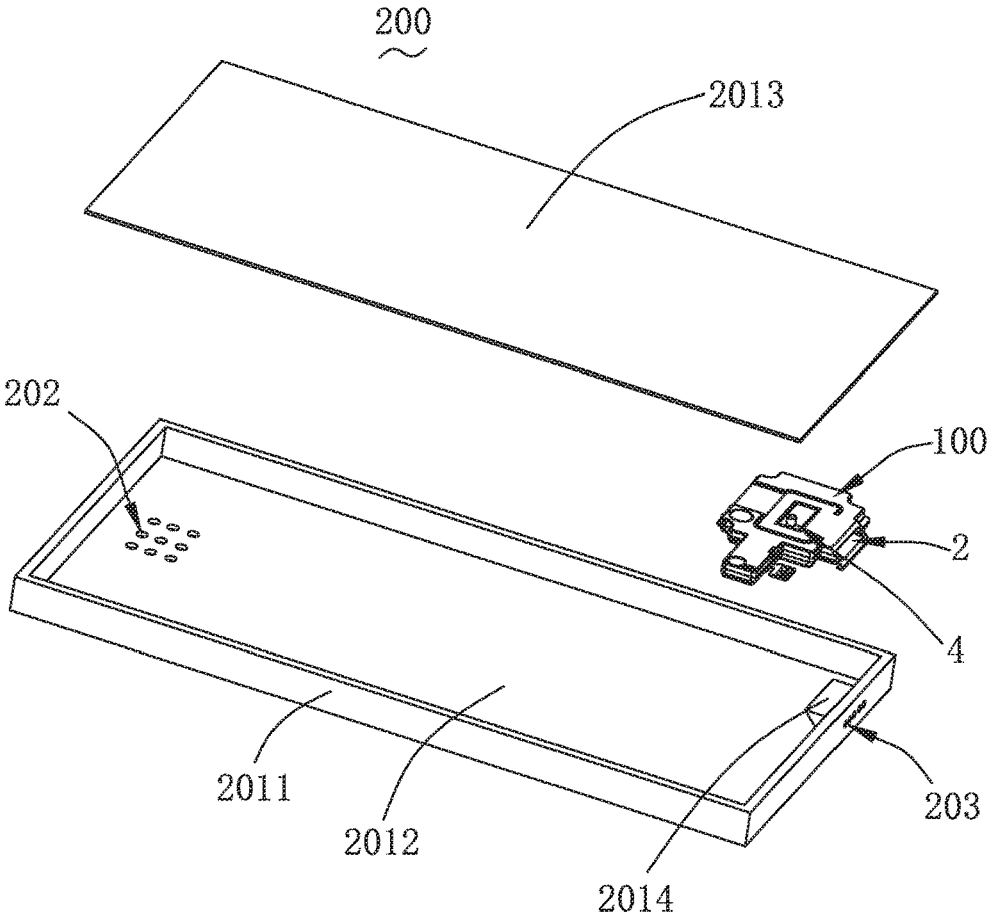
FIG. 4 is a partially exploded view of the mobile terminal of the present invention.
Figure 5:
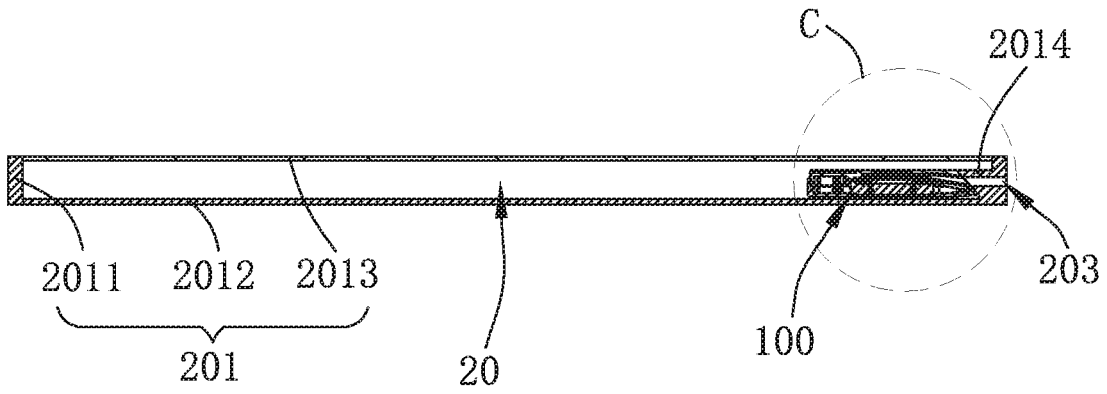
FIG. 5 is a cross-sectional view of the mobile terminal taken along line B-B in FIG. 3.
Figure 6:
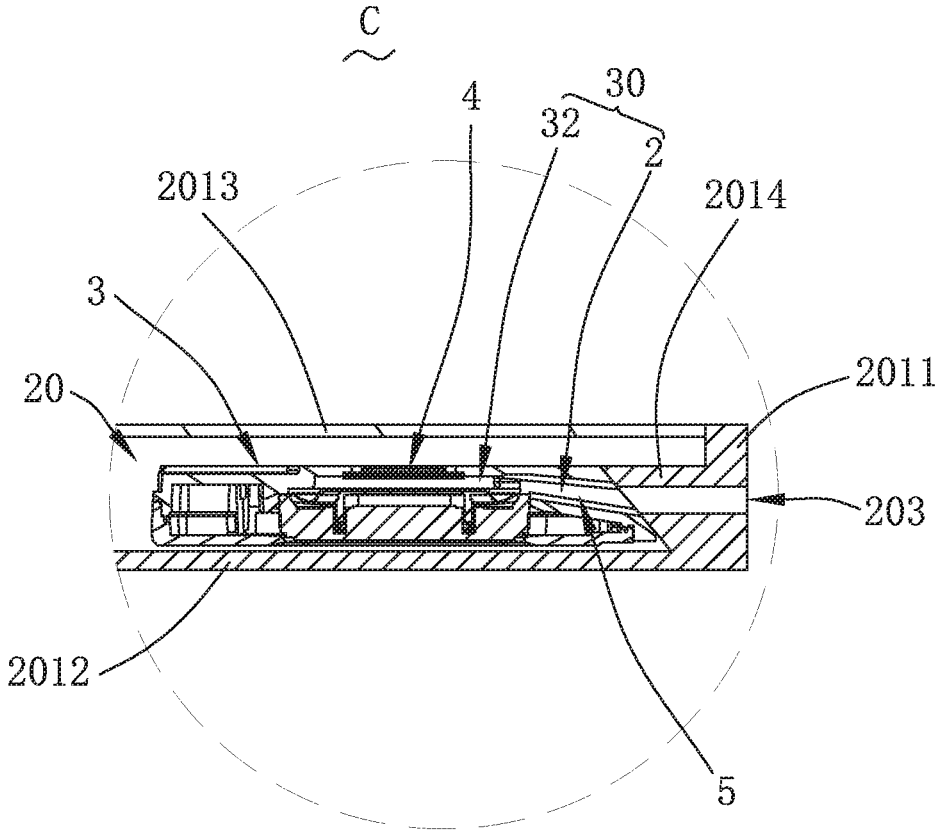
FIG. 6 is a partially enlarged view of Part C in FIG. 5.

Referring to FIGS. 1-2, the present invention provides a sounding device 100 that includes a housing body 1, a sound outlet 2, a speaker unit 3, a unidirectional intake valve 4, and a unidirectional outlet valve 5.

The housing body 1 has a containment space 10, and the sound outlet 2 is formed in the housing body 1.

The speaker unit 3 is assembled in the housing body 1. The speaker unit 3 separates the containment space 10 into a front acoustic cavity 32 and a back cavity 33. Specifically, the speaker unit 3 includes a diaphragm 31 separating the containment space 10 into the front acoustic cavity 32 and the back cavity 33.

The sound outlet 2 is formed in the housing body 1 for being communicated with the front acoustic cavity 32 to form a front cavity 30 together, and the front cavity 30 is used for sounding. The back cavity 33 is used to improve low frequency acoustic performance.

The unidirectional intake valve 4 communicates the front cavity 30 with the outside and is used to intake air into the front cavity 30.

The unidirectional outlet valve 5 communicates the front cavity 30 with the outside and is used to discharge the air in the front cavity 30 to the outside through the sound outlet 2.

In the above structure, the air outside the sounding device 100 enters the front acoustic cavity 32 from the unidirectional intake valve 4, and then flows to the sound outlet 2, and is discharged to the front cavity 30 through the unidirectional outlet valve 5 to form an air circulation.

Specifically, in this embodiment, the unidirectional intake valve 4 passes through the housing body 1 and communicates the outside with the front acoustic cavity 32. The unidirectional outlet valve 5 is arranged in the sound outlet 2 and communicates the sound outlet 2 with the outside.

Referring to FIGS. 1-6, the present invention also provides a mobile terminal 200, the mobile terminal 200 includes a housing 201 having an accommodation space 20 and the sounding device 100 provided by the present invention fitted in the housing 201.

The housing 201 is arranged with an air inlet 202 and an air outlet 203 passing through on it and respectively communicating the accommodation space 20 with the outside. The accommodation space 20 communicates with the front cavity 30 through the unidirectional intake valve 4, and the unidirectional outlet valve 5 communicates the front cavity 30 with the air outlet 203.

When the mobile terminal 200 is operating, the components inside it generate a large amount of heat, with the vibration of the diaphragm 31, the volume of the front acoustic cavity 32 changes. With the downward movement of the diaphragm 31, the volume of the front acoustic cavity 32 increases, the outside cold air enters the accommodation space 20 via the air inlet 202, and after passing through each component, the cold air takes away a part of heat with its temperature and heats up into hot air, which is then drawn into the front acoustic cavity 32 through the unidirectional intake valve 4. As the diaphragm 31 move upward, the volume of the front acoustic cavity 32 is reduced, and the hot air in the front acoustic cavity 32 flows to the sound outlet 2, and is extruded out through the unidirectional outlet valve 5 in the sound outlet 2, so as to form an air circulation for the purpose of heat dissipation.

In the embodiment, specifically, the housing 201 comprises a frame 2011 in a hollow ring shape, and an upper cover 2012 and a lower cover 2013 which are respectively arranged on two sides of the frame 2011 and enclose the accommodation space 20 together with the frame 2011.

The air outlet 203 is arranged in the frame 2011, that is, arranged through the frame 2011. The air inlet 202 is arranged at an end of the upper cover 2012 that is far away from the air outlet 203. The sounding device 100 is fixed to the upper cover 2012, the front acoustic cavity 32 is arranged close to the lower cover 2013, and the back cavity 33 is arranged close to the upper cover 2012. The structure makes the air flow path longer and the heat dissipation effect better.

Specifically, the unidirectional intake valve 4 extends through the housing body 1 and communicates the accommodation space 20 with the front acoustic cavity 32. The unidirectional outlet valve 5 is arranged within the sound outlet 2 and communicates the sound outlet 2 with the air outlet 203.

More preferably, in this embodiment, the housing 201 further includes an air outlet pipe 2014 extending from the frame 2011 into the accommodation space 20. One end of the air outlet pipe 2014 is abutted on the sound outlet 2 and communicated with each other, and the other end is abutted with the air outlet 203 and communicated with each other. The structure is used for increasing the air flow path and improving the heat dissipation effect.

In this embodiment, the surface on which the air outlet pipe 2014 and the sound outlet 2 abut on each other are inclined surface, thereby facilitating assembly.

Compared with the related art, in the sounding device and the mobile terminal of the invention, the one-way intake valve is arranged to communicate the outside and a front cavity of the sounding device and is used for introducing air into the front cavity. The one-way intake valve is arranged to communicate the front cavity of the sounding device and the outside and is used for discharging the air in the front cavity to the outside through the sound outlet, and the air enters the mobile terminal through an air inlet, is heated through components in the mobile terminal and then is discharged from the one-way outlet valve, thereby forming air circulation, facilitating internal cooling of the mobile terminal and improving the working performance and the stability.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A mobile terminal, comprising:

a housing having an accommodation space, including an air inlet and an air outlet respectively communicating the accommodation space with the outside; and a sounding device fitted in the housing, including:

a housing body having a containment space;

a speaker unit fitted in the housing body, separating the containment space into a front acoustic cavity and a back cavity;

a sound outlet formed in the housing body, communicating with the front cavity to form a front cavity together;

an unidirectional intake valve communicating the outside with the front cavity and for introducing air into the front cavity; and an unidirectional outlet valve communicating the front cavity with the outside and for discharging air in the front space through the sound outlet to the outside world; wherein the accommodation space is communicated with the front cavity through the unidirectional intake valve, the unidirectional outlet valve communicates the front cavity with the air outlet;

the housing comprises a hollow annular frame and an upper cover and a lower cover which are respectively arranged on two sides of the frame as a cover and enclose the accommodation space together with the frame; the air outlet is arranged at the frame, and the air inlet is arranged at one end of the upper cover far away from the air outlet the front acoustic cavity is arranged close to the lower cover, the back cavity is arranged close to the upper cover; the unidirectional intake valve passes through the housing body and communicates the accommodation space with the front acoustic cavity; the unidirectional outlet valve is arranged in the sound outlet and connects the sound outlet with the air outlet;

the housing further comprises an air outlet pipe extending from the frame into the accommodation space, the air outlet pipe has one end abutting against the sound outlet and communicated with each other, and another end abutting against the air outlet and communicated with each other.

2. The mobile terminal as described in claim 1, wherein the surface on which the air outlet pipe and the sound outlet abut on each other is an inclined surface.

* * * * *